US006414701B2

(12) United States Patent
Seu et al.

(10) Patent No.: US 6,414,701 B2
(45) Date of Patent: Jul. 2, 2002

(54) DRUM TYPE HARD COPY APPARATUS

(75) Inventors: Preston Dow Seu; David J. Lowe, both of Vancouver, WA (US); Clement C. Lo, Lake Oswego, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/370,722

(22) Filed: Aug. 9, 1999

(51) Int. Cl.[7] ..... B41J 2/01
(52) U.S. Cl. ..... 346/136
(58) Field of Search ..... 346/138, 136; 400/613; 347/104

(56) References Cited

U.S. PATENT DOCUMENTS

| | | | | |
|---|---|---|---|---|
| 4,533,926 A | * | 8/1985 | Foldvari et al. | 346/136 |
| 4,707,704 A | | 11/1987 | Allen et al. | 346/24 |
| 4,769,652 A | * | 9/1988 | Cleary et al. | 347/104 |
| 5,121,139 A | * | 6/1992 | Burke | 346/140 R |
| 5,598,201 A | * | 1/1997 | Stodder et al. | 347/104 |

FOREIGN PATENT DOCUMENTS

| | | | |
|---|---|---|---|
| EP | 0 401 036 | 12/1990 | |
| EP | 0664218 A3 | 7/1995 | B41J/2/20 |
| JP | 62294569 | 12/1987 | |
| JP | 01061277 | 8/1989 | |
| WO | WO 99/04368 | 1/1999 | |

OTHER PUBLICATIONS

European Patent Office Search Report dated Mar. 1, 2001.

* cited by examiner

*Primary Examiner*—John Barlow
*Assistant Examiner*—An H. Do

(57) ABSTRACT

A printing media cartridge for a drum-type hard copy apparatus has printing media supply within the drum. Printable sheet lengths of printing medium are extracted from the interior of the drum through a slot such that individual prints can be produced using the drum outer surface as a platen. Removing a print from the platen extracts the next sheet length from within the drum which is then automatically wrapped back onto the drum's outer surface and aligned for the next print cycle. Printer control encoding is provided with the cartridge.

19 Claims, 9 Drawing Sheets

DRUM TYPE HARD COPY APPARATUS

BACKGROUND OF THE INVENTION

1. Field of the Invention

The present invention relates generally to hard copy printing and more specifically to a methods and devices for containing and feeding printing media in a drum type hard copy apparatus.

2. Description of Related Art

The art of hard copy printing technology is well developed in commercial products such as computer printers, graphics plotters, copiers, and facsimile machines. One specific type of hard copy printing employs ink-jet technology for producing the hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [sic] *Devices*, chapter 13 (Ed. R. C. Durbeck and S. Sherr, Academic Press, San Diego, 1988). In order to explain the present invention, a ink-jet hard copy apparatus will be used as an exemplary embodiment. As the present invention may be extended to other forms of printing, no limitation on the scope of the invention is intended by the use of this exemplary embodiment nor should any such intention be implied.

FIG. 1 (PRIOR ART) depicts an ink-jet hard copy apparatus (with its cover shell removed, in this exemplary embodiment a computer peripheral printer, 101. A housing 103 encloses the electrical and mechanical operating mechanisms of the printer 101. Operation is administrated by an electronic controller 102, usually a microprocessor or application specific integrated circuit ("ASIC") controlled printed circuit board connected by appropriate cabling to a computer (not shown). It is well known to program and execute imaging, printing, print media handling, control functions and logic with firmware or software instructions for conventional or general purpose microprocessors or with ASIC's. Cut-sheet print media 105, loaded by the end-user onto an input tray 120, is fed by a suitable paper-path transport mechanism (not shown) to an internal printing station, or printing zone, 107 where graphical images or alphanumeric text is created. A carriage 109, mounted on a slider 111, scans the print medium. An encoder 113 is provided for keeping track of the position of the carriage 109 at any given time. At least one, or a set, of individual ink-jet pens, or print cartridges, $\mathbf{115}_x$ are releasable mounted in the carriage 109 for easy access. Generally, in a full color system, inks for the subtractive primary colors—cyan, yellow, magenta (CYM)—and true black (K) (F standing for a fixer fluid) are provided in remote, or "off-axis," replaceable or refillable, ink reservoirs $\mathbf{117}_x$ having fluidic couplings 119 to the pens $\mathbf{115}_x$. Once a printed page is completed, the print medium is ejected onto an output tray 121. It is common in the art to refer to the pen scanning direction as the x-axis, the paper feed direction as the y-axis, and the ink drop firing direction as the z-axis.

Hard copy apparatus, be it in the form of a printer, plotter, copier, scanner, facsimile machine, or the like, share the need for having a blank printing media supply, preferably in an automated-feeder device appurtenant to the hard copy apparatus. In turn, printing media come in a variety of forms. A common computer printer 101, such as a Hewlett-Packard™ DeskJet™ ink-jet printer as depicted in FIG. 1, is usually designed to be compatible with a variety of media, such as plain paper, special paper, transparencies, and envelopes, up to and including legal size (8.5×14-inches) media as are commonly used in an office or home environment. On the other hand, a common large format plotter 201, such as an ink-jet plotter like the Hewlett-Packard DesignJet™ series illustrated by FIG. 2 (Prior Art), requires accommodation for large sheets, or continuous, media 203, currently up to eighty inches in the scanning x-axis width dimension. As the computing arts expand into new fields, such as palm top computers or specialized computer printing needs, such as dedicated photograph ink printing as in the Hewlett-Packard PhotoSmart™ digital camera 300 direct printer 303 series depicted by FIG. 3 (Prior Art), other sizes of printing media (e.g., 3.5×5 for photographs) and other forms of recording media, such as cloth (e.g., for ink printing on T-shirts) and advanced automated-feeder devices are needed.

Herein, the terms "recording" and "printing" are used synonymously, intended to include the action of applying any type of colorant (e.g., ink, toner, and the like) to any kind of printing medium (e.g., paper, cloth, plastic, flexible materials, and the like)—referred to hereinafter generically as "paper"—and any kind of hard copy producing apparatus—referred to hereinafter generically as a "printer."

One specific type of hard copy apparatus is generically referred to as a "drum printer." A schematic depiction of a drum printer 401 is shown in FIG. 4 (Prior Art). The operational functions of the printer are administered by an electronic controller 402, as would be known in the art, coupled to an input/output device 400, such as a computing apparatus. A drum printer 401 wraps a sheet of paper 403 from a provided supply 405 around a rotating cylinder 407 which then acts as a paper platen. A writing instrument 409 is located parallel to the drum surface or has a carriage (not shown), carrying one or more writing instruments as demonstrated by FIGS. 1 and 2, that travels along an axis parallel to the cylinder's rotational axis. In a scanning carriage type drum printer, both carriage and drum velocities are held constant during printing to keep power consumption low and reduce dynamic operational problems, such as accounting for carriage reversal acceleration and deceleration ramp distances and durations during a print cycle. In general, drum printers have a higher throughput ("pages per minute" or "ppm") than flat bed scanning carriage printers such as shown in FIGS. 1 and 2.

Drum printers have design variations such as having a less than "page wide", "W," writing instrument stationary while the medium 403 rotates with the cylinder 407, moving the writing instrument only between printing each successive swath. Having the writing instrument stationary provides inherent print quality enhancing capabilities. The medium 403 does not cover the entire circumference of the drum; that is a gap, "G," separates the medium's leading edge 411 and trailing edge 413. The writing instrument is shifted quickly to start printing a next swath while this gap on the drum is passing. In another design variation, helical scanning by a writing instrument can be provided by slowing scanning the writing instrument carriage while the drum rotates or by translating the drum relative to a stationary writing instrument.

A main problem with drum printers is the loading and holding of the medium to the cylinder surface. Print quality may be degraded by variations of the medium registration to the drum surface. Manual taping or clamping is cumbersome and time consuming. Automated pick-and-feed mechanisms associated with an input tray combined with mechanical or electromechanical edge clamping devices improve the loading cycle time and eliminate the need for user intervention. Such mechanisms add significant complexity and cost to manufacture. Automated pick-and-feed mechanisms associated with an input tray combined with vacuum holddown cylinder drum printers are also known. Such vacuum systems also add significant complexity and cost to manufacture. Moreover, localized suction forces from the pattern of vacuum through-holes in the cylinder surface are generally transmitted through the printing medium and thus also can effect the print quality. Both automated clamping and vacuum systems compromise the desire for a small workplace footprint. Mechanical clamping requires precise timing. Vacuum systems require costly exhaust systems which also require a significant power supply.

All of the foregoing shortcomings of the prior solutions are exacerbated by the need to accommodate multiple printing media sizes. Mechanical holddowns may require segmented clamps coordinated with the current medium in use. Smaller width media on a vacuum holddown leaves vacuum ports in the cylinder uncovered, changing the suction flow dynamic. Maintaining the pressure difference necessary to hold the medium to the surface requires either higher air flow or adaptive mechanisms for closing uncovered ports.

There is a need for methods and devices for storing and holding printing media for a drum printer.

SUMMARY OF THE INVENTION

In a basic aspect, the present invention provides a print media cartridge device including: a supply of print media in a format such as a substantially cylindrical roll; a containing mechanism for containing the supply of print media in an interior chamber of the containing mechanism, wherein the containing mechanism is a substantially cylindrical construct having an outer surface for sequentially receiving at least one sheet of the supply thereon from within the containing mechanism via an aperture coupling the outer surface to the interior chamber; and mounting mechanism for mounting the print media cartridge device adjacent mechanisms for printing on the print media of a hard copy apparatus adapted for using the device.

In another basic aspect, the present invention provides a hard copy apparatus including: a writing instrument; mounted adjacently to the writing instrument, a removable, rotating drum platen having an outer surface, the outer surface including an aperture of a width sufficient for passing print media therethrough; a supply of print media contained within the drum in an orientation for continuously, sequentially feeding print media through the aperture such that at least one sheet length of the print media is wrapped around the drum platen when extracted from the drum; at least one mechanism for temporarily securing a leading edge of the sheet length wrapped around the drum platen to the outer surface such that the sheet length is positioned with respect to the writing instrument for receiving colorant therefrom; associated with the drum platen, at least one mechanism for encoding printing operation information; and associated with the writing instrument, at least one mechanism for recognizing the information.

In another basic aspect, the present invention provides a method of providing print media to a rotating drum type hard copy apparatus including the steps of: providing the apparatus with a replaceable rotating drum construct mountable on the apparatus and having a supply of print media contained within the drum construct, wherein the supply of print media is in a form such that the media is extractable from within the drum construct via an aperture in an outer surface of the drum, the outer surface configured for holding predetermined lengths of the media extracted from within the drum construct such that the surface forms a printing platen in the apparatus; and periodically replacing the rotating drum construct with a rotating drum construct cartridge having a replacement supply of print media therein.

In another basic aspect, the present invention provides a method of providing print media to a rotating drum type hard copy apparatus including the steps of: providing the apparatus with a refillable rotating drum construct mountable on the apparatus and having a supply of printing media contained within the drum construct, wherein the supply of printing media is in a form wherein the media is extractable from within the drum construct via an aperture in an outer surface of the drum, the outer surface configured for holding predetermined lengths of the media extracted from within the drum construct such that the surface forms a printing platen in the apparatus; and periodically replacing the supply of printing media drum within construct with a replacement supply of print media therein.

In another basic aspect, the present invention provides a method of producing hard copy including the steps of:

a) providing a drum platen with an internal supply of a continuous printing medium;
b) extracting through the drum platen a first length of printing medium from the supply by a leading edge;
c) wrapping the first length about the drum platen;
d) securing the leading edge of the first length to the drum platen proximate a trailing edge of the first length;
e) printing on the first length by rotating the drum platen in a first direction passed a writing instrument;
f) releasing the leading edge;
g) pulling the first length away from the drum platen wherein the drum platen is rotated in a second direction opposite the first direction;
h) stop locking the drum platen in a predetermined position wherein the step of pulling further extracts a next length of printing medium from within the drum platen;
i) separating the first length from the next length;
j) rotating the drum platen in the first direction such that the next length is wrapped around the drum platen;
k) securing the leading edge of the next length to the drum platen proximate a trailing edge of the next length; and
l) repeating steps e) through k) for each hard copy to be produced.

Some advantages of the present invention are:

the present invention provides a compact and low cost printing media cartridge for a drum printer;

the present invention provides a disposable or reloadable printing media cartridge having recognizable encoding for printing operation controls;

the present invention provides a printing media cartridge that also serves as a drum platen for a drum printer;

the present invention provides a simple mechanism for loading a recording medium into a hard copy apparatus;

the present invention provides a disposable mechanism for loading a recording medium into a hard copy apparatus;

the present invention provides a replaceable mechanism for loading a recording medium into a hard copy apparatus;

the present invention provides manufacturer-loadedable, reliable printing medium supplies;

the present invention provides a mechanism for encoding printing medium types and printing characteristics, automatically recognizable by a hard copy apparatus;

the present invention provides for a printing medium encoding scheme that can use the same sensor used for drum speed control; and the present invention provides for a low cost solution to drum printer supply and loading procedures.

The foregoing brief summary of the basic aspects of the invention and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprize the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

BRIEF DESCRIPTION OF THE DRAWINGS

FIGS. 7A and 7B are planar view of the present invention as shown in FIG. 5 as oriented with an exemplary printhead in which:

FIG. 7A is a top view, and

FIG. 7B is a side view.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable. Again, for convenience and to simplify the description, the present invention is detailed with respect to an exemplary embodiment for an ink-jet hard copy apparatus. No limitation on the scope of the invention is intended by the use of this exemplary embodiment nor should an be implied therefrom.

Figure 4:
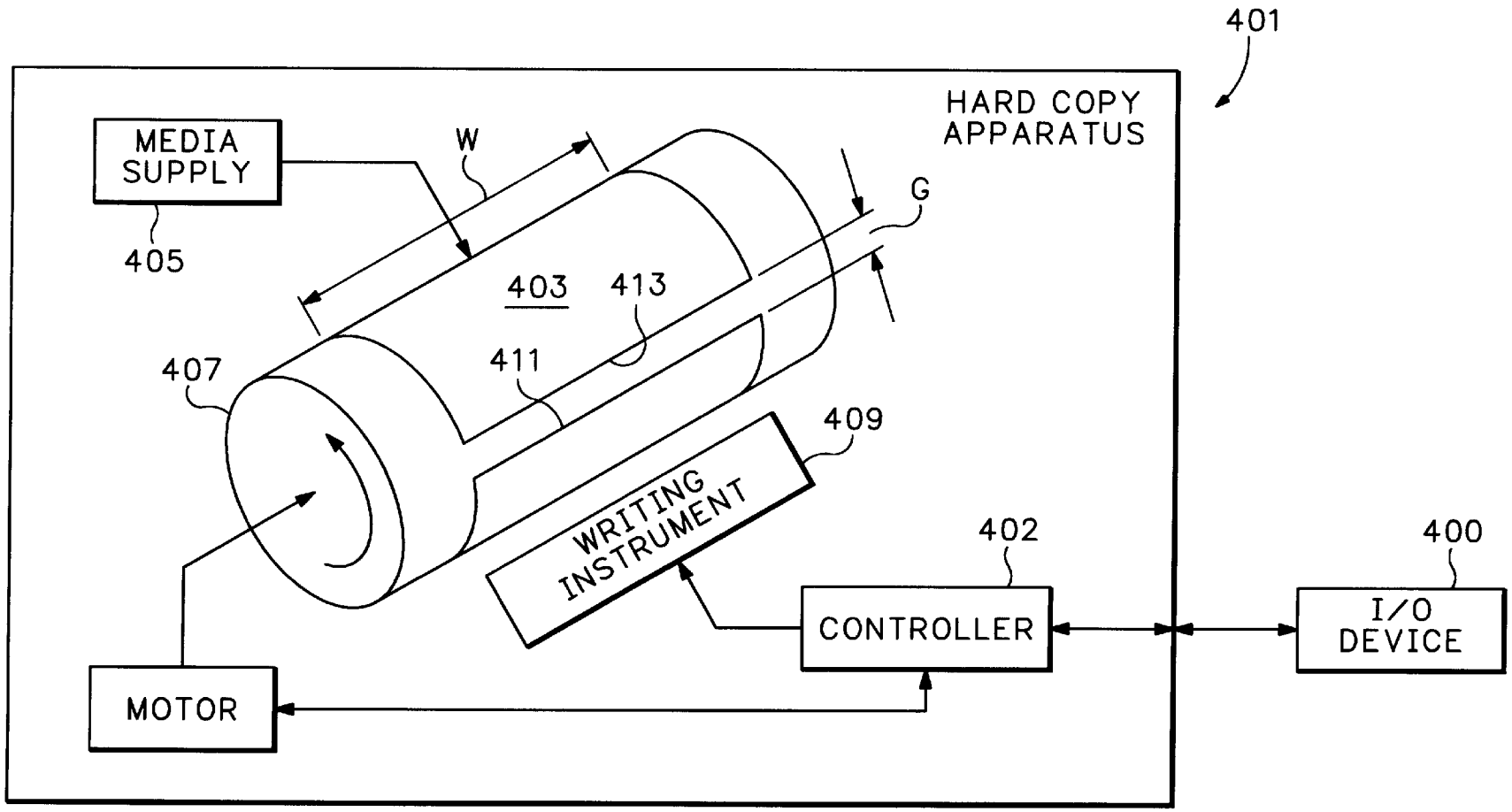
FIG.4 (PRIOR ART)
FIG. 4 (Prior Art) is a schematic depiction of a drum printer.
Figure 5:
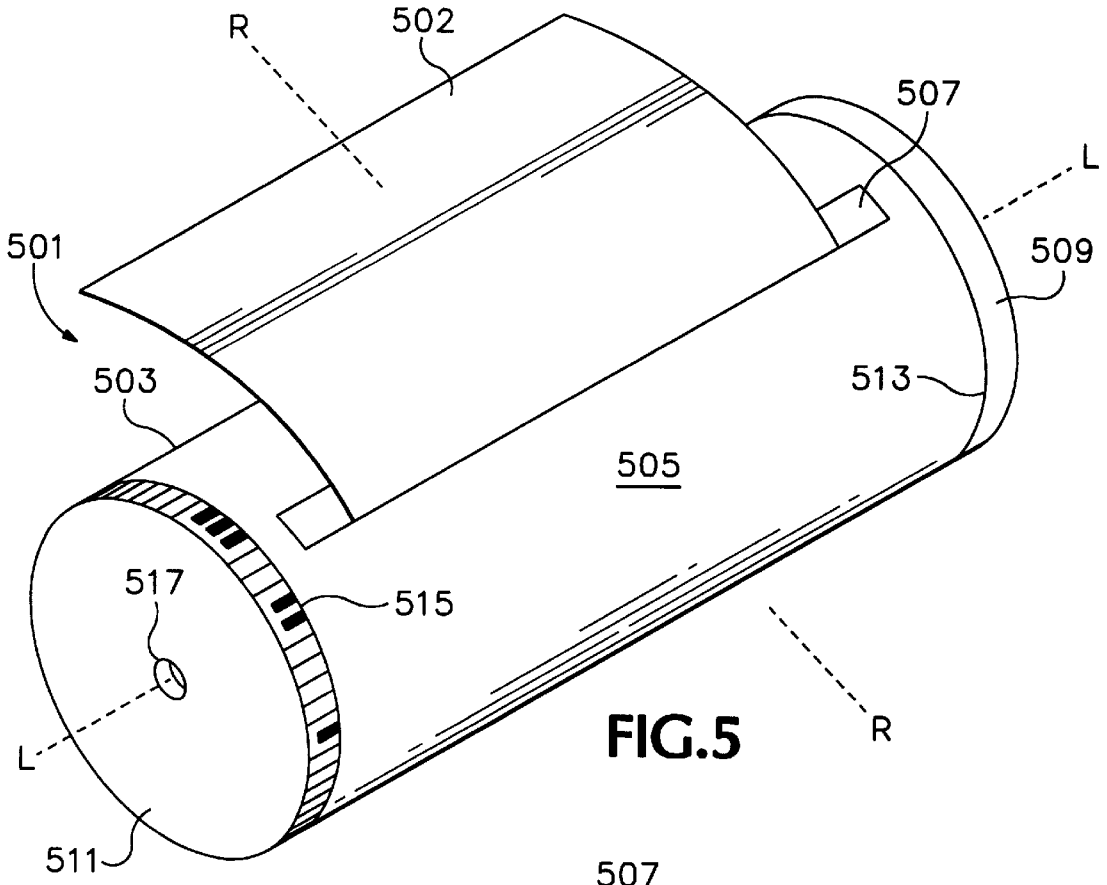
FIG. 5 is a schematic depiction, perspective view of a printing media drum cartridge in accordance with the present invention.

FIG. 5 illustrates a printing medium drum cartridge 501 in accordance with the present invention. The physical dimensions of the cartridge 501 will vary proportionately with the size—both width and length, where the length relates to the volume of the supply—and type of paper supply 502 employed therewith. The cartridge 501 has a generally cylindrical barrel 503, having an outer surface 505. The barrel 503 is characterized by an aperture, or slot, 507, therethrough. The slot 507 is parallel to the longitudinal axis ("L - - - L") of the cylindrical barrel 503, which is also the axis of rotation of the drum cartridge 501. The slot 507 has an axial length sufficient for allowing a predetermined width of paper 502 to pass therethrough. Two end caps 509, 511—which may be removable for a reloadable implementation—provide closures for the two respective ends 513, 515 of the cylindrical barrel 503, having a central aperture 517 for receiving an axle of a printing medium drum cartridge adapted printer, e.g., adaptations of FIGS. 1–4. The outer surface 505 serves as a drum platen for the printer in which the drum cartridge 501 is installed (see FIG. 4). The cartridge 501 can be manufactured to be a one-time use, disposable unit or reusable.

Figure 6:
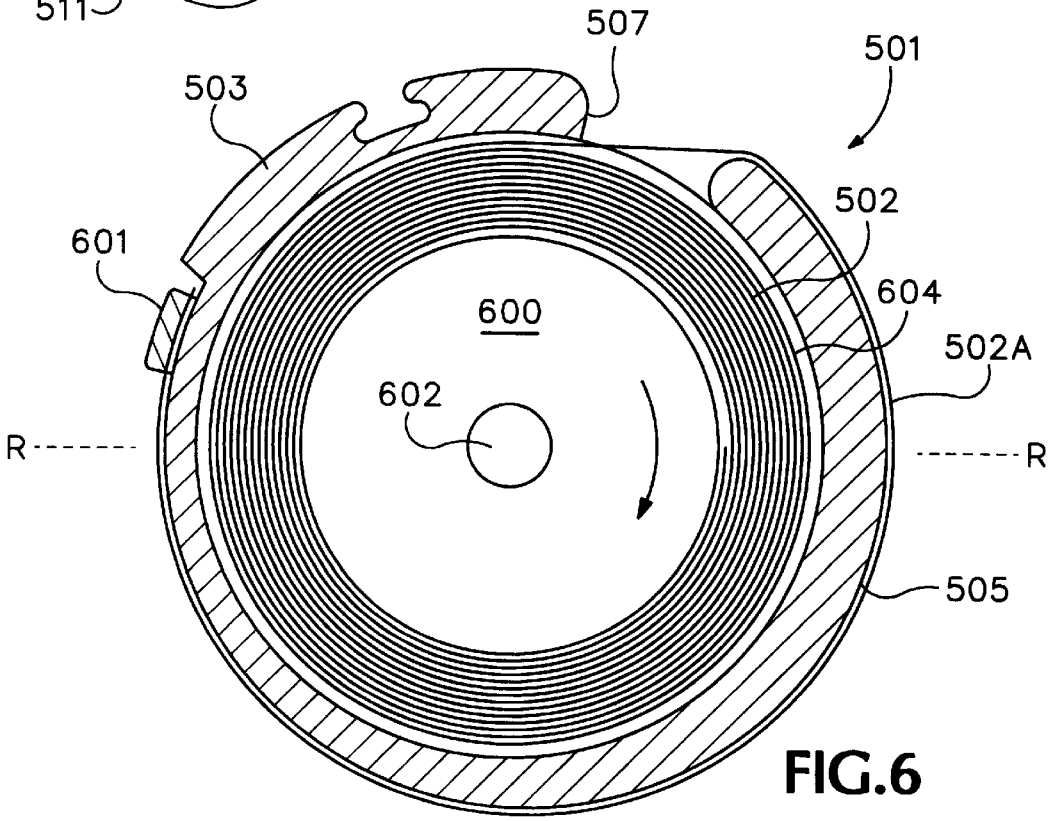
FIG. 6 is a cross-sectional view of the present invention taken in a radial plane R—R as shown in FIG. 5.

FIG. 6 depicts the cartridge 501 in a cross-sectional aspect (radial plane "R - - - R," FIG. 5). The paper supply 502 is contained in a rolled configuration about a hub 600 inside of the barrel 503. Other media containment configurations, e.g., fan-fold and the like as would be known in the art can be implemented to suit a particular design implementation. The inner surface of the barrel 503 and the outer surface of the paper supply hub 600 form a chamber that holds the paper supply 502. The depiction shows a length of paper 502A that has been extracted from the chamber and wrapped about a segment of the circumference of the drum surface 505 equivalent to the length, e.g., for a photo-printer (FIG. 3), approximately five inches from leading edge to trailing edge. The extracted length 502A is thus positioned for printing with the drum surface 505 acting as a platen. Note that the print media supply 502 can be a continuous roll, or a segmented roll of paper separated by tear perforations, or a compressed, rolled series of cut sheets that are releasably held together (e.g., with a releasable glue) for separation after initial extraction, wrap about the platen, and printing, or the like as may be employed in accordance with any specific implementation. Whichever type is employed, it is configured to be extracted in a sheet form from the interior of the barrel 503 through the slot 507 and wrapped about the drum cartridge surface 505 as illustrated by region 502A of the paper. A known manner clamping mechanism 601 holds the picked and extracted sheet 502A leading edge against drum cartridge surface 505. The print media hub 600 has an axle shaft 602 therethrough which is aligned with end cap 509, 511 apertures 517. Note also that multiple print length surface wrap embodiments can be implemented.

Figure 7A:
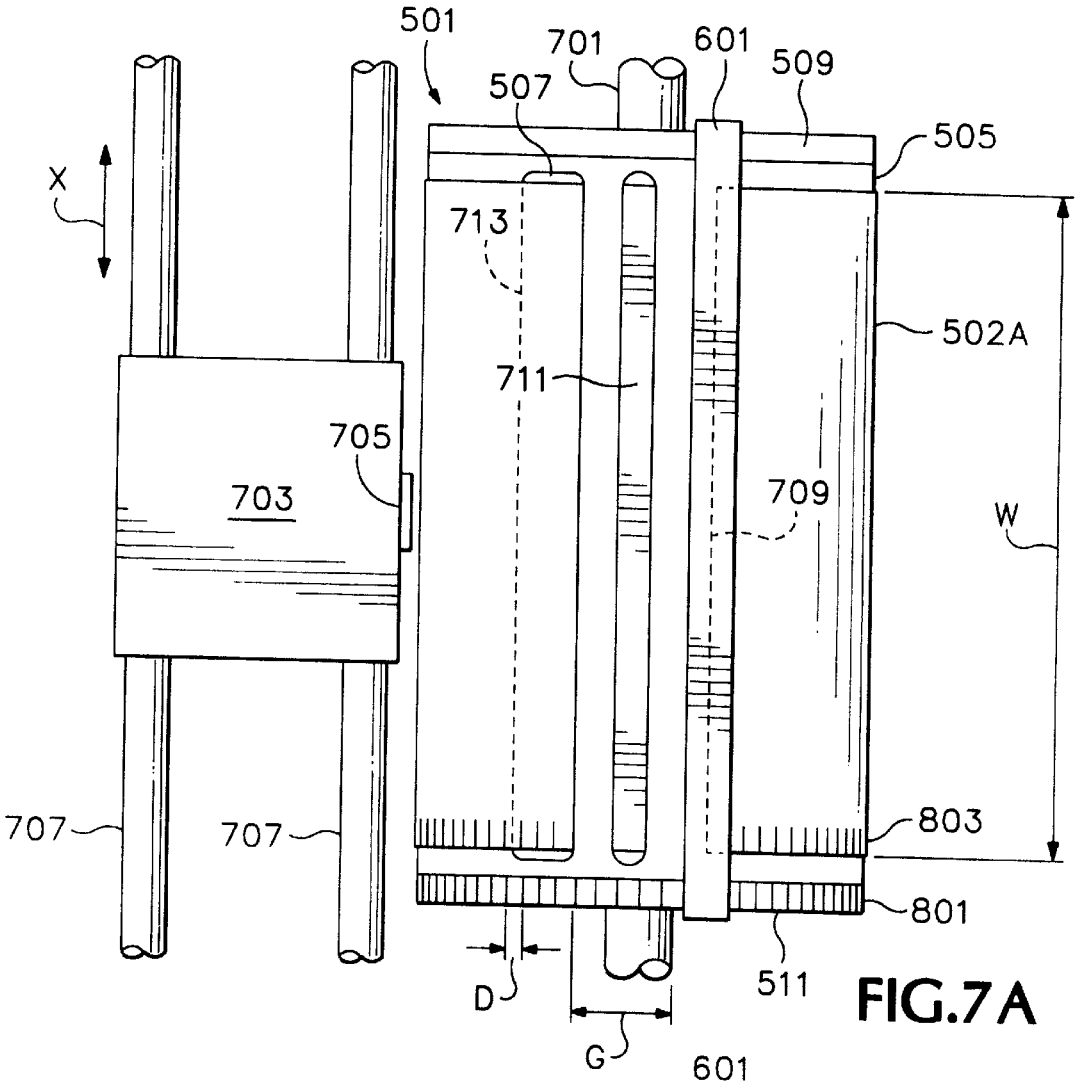
Figure 7B:
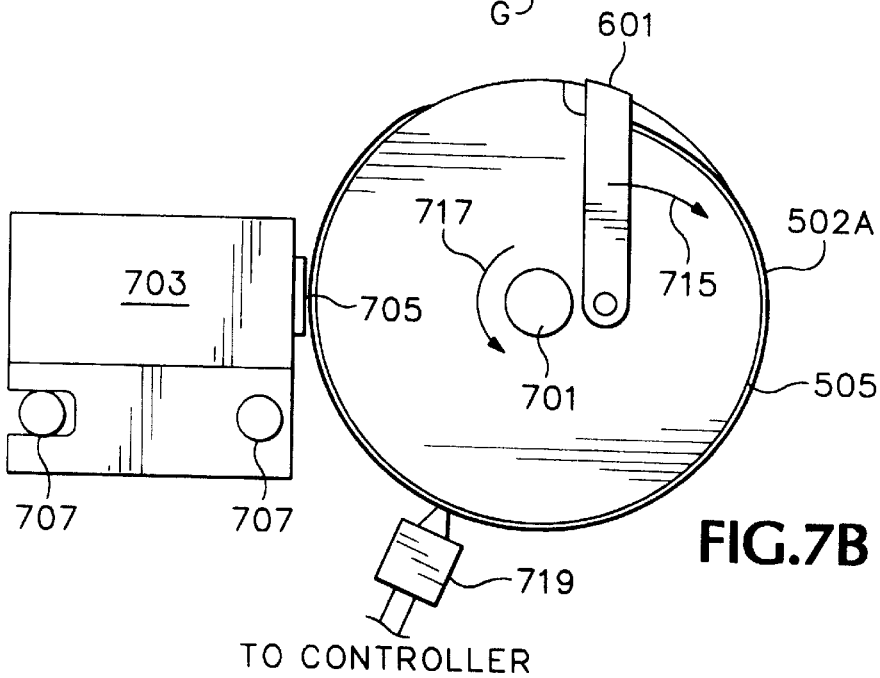

FIG. 7A is a top view schematic depiction of the printing media drum cartridge 501 mounted via axle shaft 602 (FIG. 6) and end cap apertures 517 (FIG. 5) on an axle 701 of an adapted hard copy apparatus and suitably mounted therein adjacent a writing instrument (e.g., element 409 of FIG. 4). FIG. 7B is a side elevation view of FIG. 7A. In this alternative embodiment, the writing instrument is an exemplary ink-jet pen 703 having a printhead 705, mounted in a known manner (see the carriage 109, FIGS. 1 and 2) on slider bars 707 for translational scanning in the x-axis across at least the width, "W," of the extracted sheet 502A wrapped circumferentially about the drum cartridge surface 505.

For an ink-jet implementation, where it is known that occasional servicing of printheads is required, an optional spittoon region 711 (such as an absorbent pad) for nozzle spitting between printing cycles can be incorporated into the gap region, "G," of the drum surface 505 between the clamped leading edge 709 of the wrapped sheet 502A and printable trailing edge 713—e.g., a perforated tear line—of the extracted sheet. In a disposable drum cartridge implementation, this provides an additional advantage of having waste ink removed from the printer environment with each print media cartridge.

The leading edge 709 of sheet 502A wrapped about the drum surface 505 is captured and held against the drum cartridge surface by the clamping mechanism 601 which can be, for example an arm mounted and cammed in a known manner to move, arrow 715, in coordination with the drum cartridge rotation, arrow 717, about the axle 701 (this is further explained with respect to FIGS. 9A–9G). Other known manner mechanisms, such as pinch rollers or the like as would be known in the art, for temporarily securing the leading edge 709 may be employed in accordance with the present invention.

Figure 8:
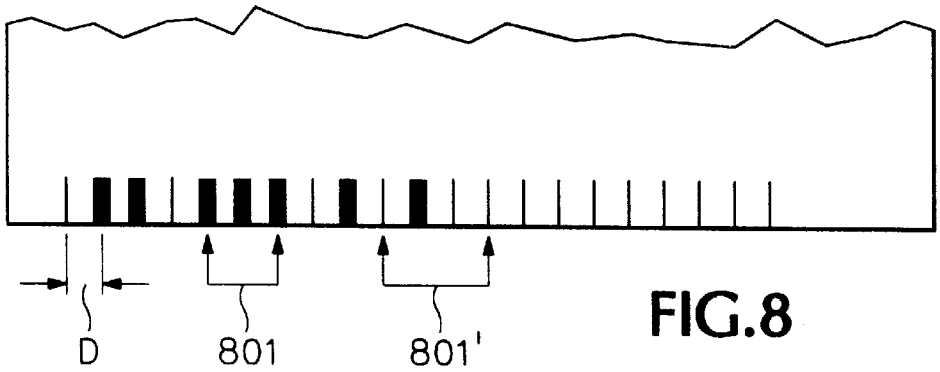
FIG. 8 is a schematic depiction of markings used to supply print media and timing information to a printer controller and driver software.

Referring to FIG. 7A and FIG. 8, the drum or the media or both can be provided with informational markings 801. These markings 801 are to provide location information and media information for the controller 102 (FIG. 1) and the printing device driver software as would be known to a person skilled in the art. The distance, "D," between light and dark transitions—e.g., leading edge to leading edge—is kept constant which provides a speed control timing mechanism for a known manner optical sensor 719 associated with the controller 102 and driver software. The width of the dark bars 801 is variable. The sequence of wide bars 801' and narrow bars—often referred to in the art as a "bar code"—produces the encoding of other information, such a medium type and quantity. Providing marks on both the media and the drum as shown in FIG. 7A allows for locating the media code in a determinable relationship to the drum's features, giving an paper encoded, index feature 803 for locating or adjusting the actual printing operation. The coding method used in any particular implementation of the present invention would require sufficient redundancy so that a decoding method can reliably recognize a start and stop of the coded information which in turn is used to locate the printing region on a wrapped sheet for the next print data. Moreover, special bar widths not used in the coding scheme could be detected and used for other purposes for a specific implementation. As examples, the printer might use the medium information to optimize printing by adjusting the immediate print mode for each new code, indicating type and size automatically; page numbers could be encoded and used to indicate when the remaining quantity with the drum is nearing an end. Other methods of timing on the drum can be employed—e.g., the use of known position reflectors, blackout regions, holes for a transmissive type sensor, and the like as would be known in the art. Note also that this could enable a first length of paper to have a header which defines the control and printing information for the whole roll.

Figure 1:
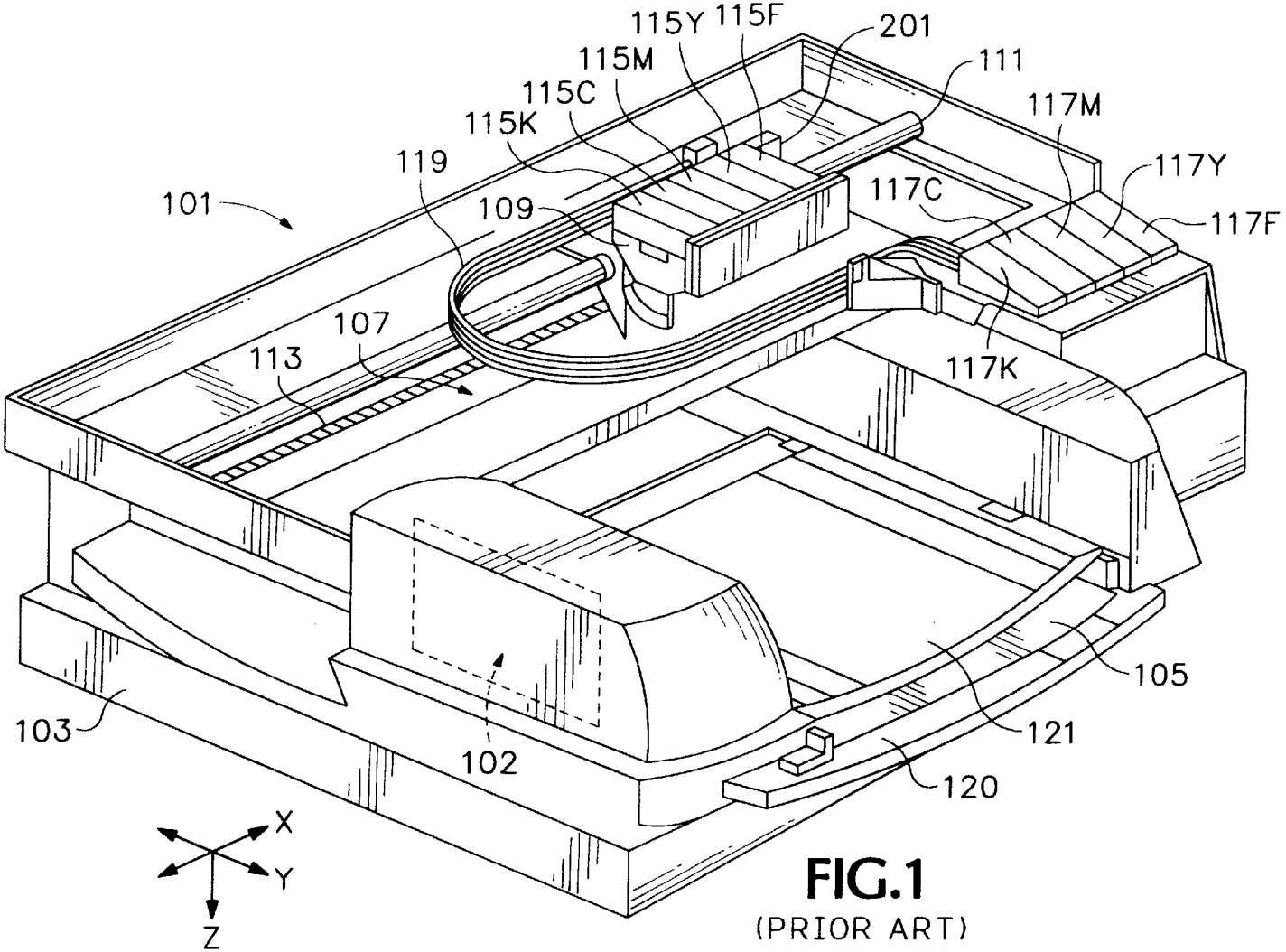
FIG.1 (PRIOR ART)
FIG. 1 (Prior Art) is a perspective view illustration of a computer printer.
Figure 2:
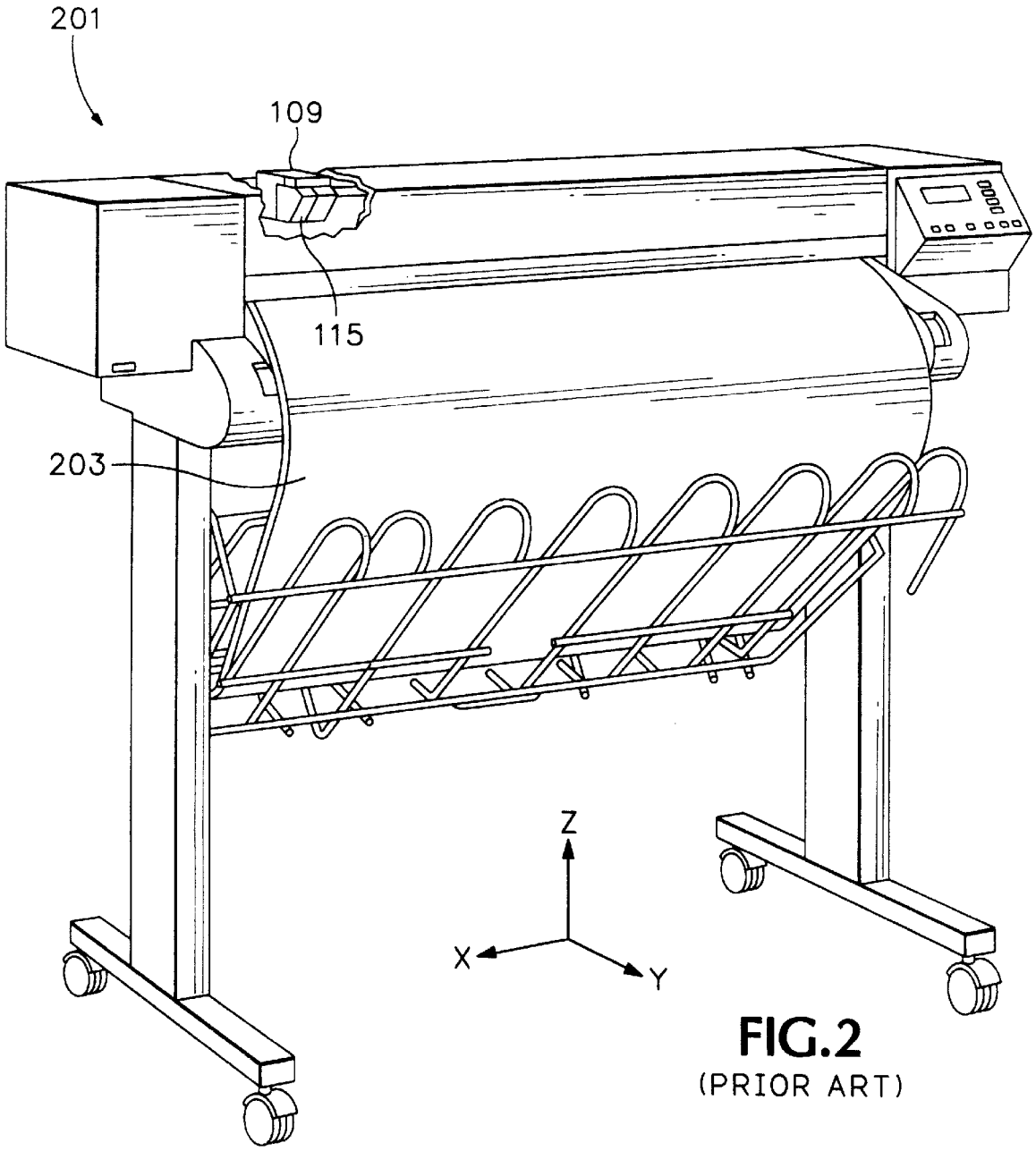
FIG.2 (PRIOR ART)
FIG. 2 (Prior Art) is a perspective view illustration of a computer plotter.
Figure 3:
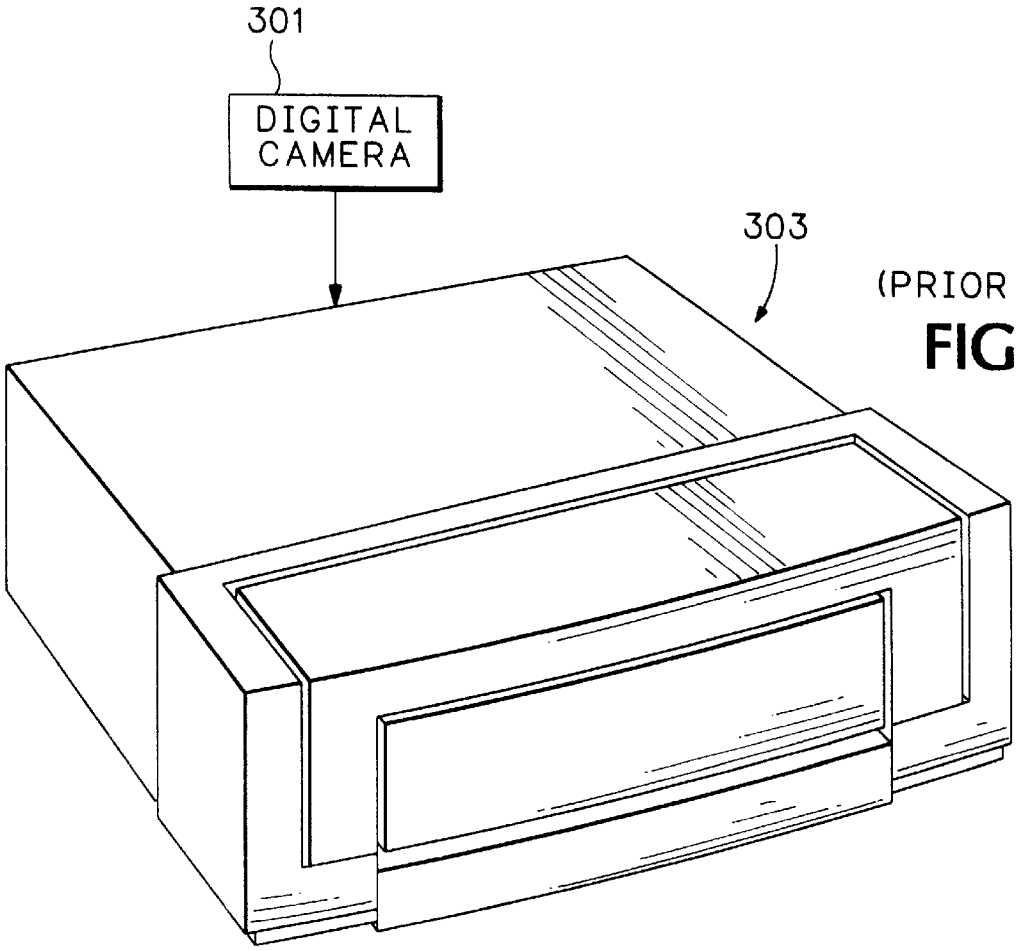
(PRIOR ART) FIG.3
FIG. 3 (Prior Art) is a perspective view illustration of a small paper format, dedicated, digital photograph printer.

In another alternative, such as a dedicated printer as shown in FIG. 3, a disk with timing marks can be made an integral part of the printer fixedly mounted with respect to axle the cartridge 701 (FIGS. 7A and 7B) wherein the drum cartridge is simplified and manufactured at lower costs, needing only mechanical features that mate to the disk in a consistent manner. Such an implementation would require another mechanism for reading additional information provided on the drum itself or on the media.

In another alternative embodiment, the cylindrical construct cartridge maybe designed to be permanent and refillable. A supplied roll of paper on a disposable hub 600 (FIG. 6) can be accompanied by an end cap 511, FIG. 7A, adapted for a predetermined positional attachment to the cartridge and bearing appropriate operational information encoded thereon for the new roll.

Figure 9A:
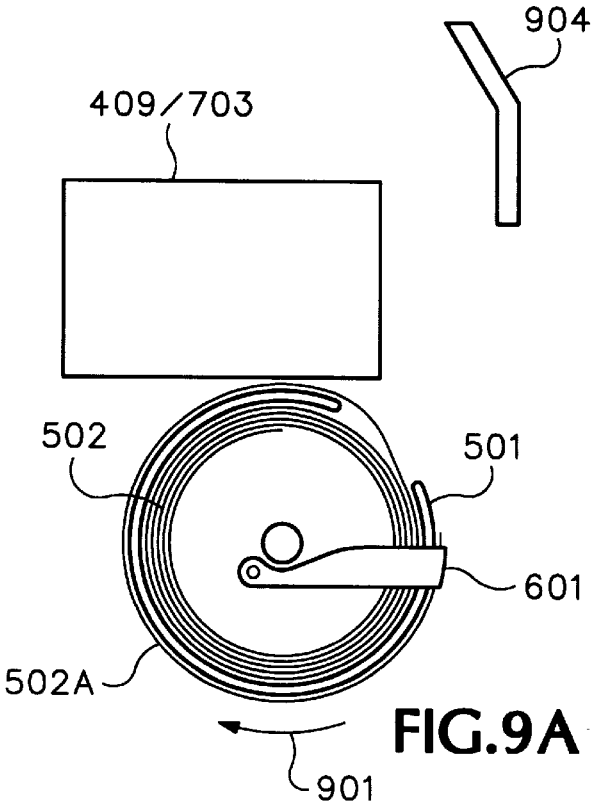
FIGS. 9A through 9G are schematic representations of the methodology of the present invention.

An exemplary embodiment for a low cost implementation using manual picking and feeding of paper is shown in FIGS. 9A–9G. Such an embodiment would be particularly useful in a portable environment or a child's toy printer where simplicity is a key design factor. Referring to FIG. 9A, a scanning writing instrument 409 (FIG. 4)—in this example, ink-jet pen 703—has a translational movement across the drum 501 (into the page) with the centerline of the pen's printhead nozzles approximately tangential to the drum as the drum rotates in the direction of the arrow 901. In FIG. 9A, a printing job has been completed on a sheet length of print media from the paper supply 502; that is, a finished print 502A is still wrapped about the drum cartridge surface, with its leading edge under clamp 601.

Figure 9B:
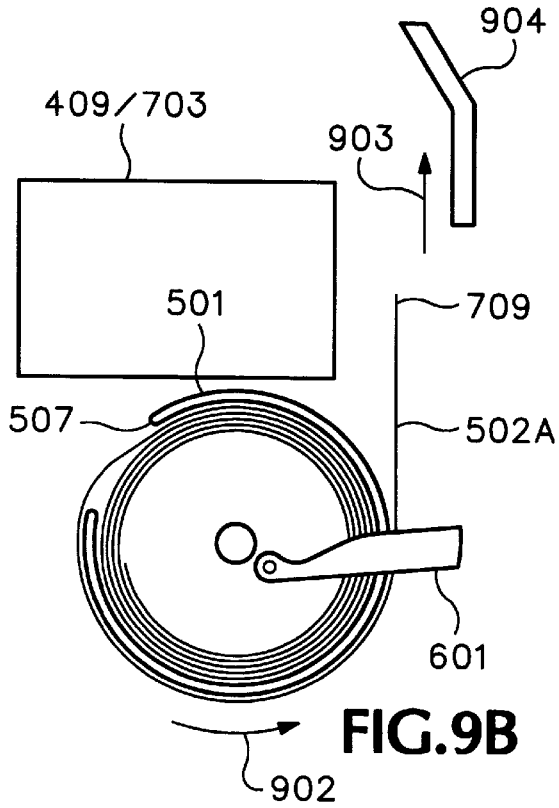

Referring now to FIG. 9B, the drum 501 rotation is reversed as indicated by the arrow 902. In this simple exemplary embodiment this is effected by merely pulling the clamp 601 outwardly away from the drum surface; it will be recognized by those skilled in the art that known manner, mechanical, directional biasing can be employed but that the concept can be expanded to an automated, partial or full print removal and media advance mechanism with known technology. The finished print 502A is unrolled from the outer surface of the drum 501 by pulling in the direction of the arrow 903 in the direction of a tear bar 904 associated with the printer apparatus.

Figure 9C:
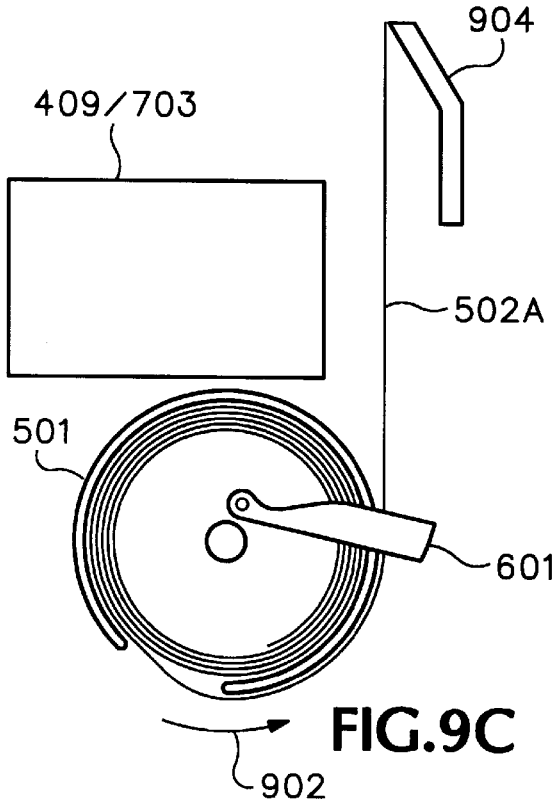
Figure 9D:
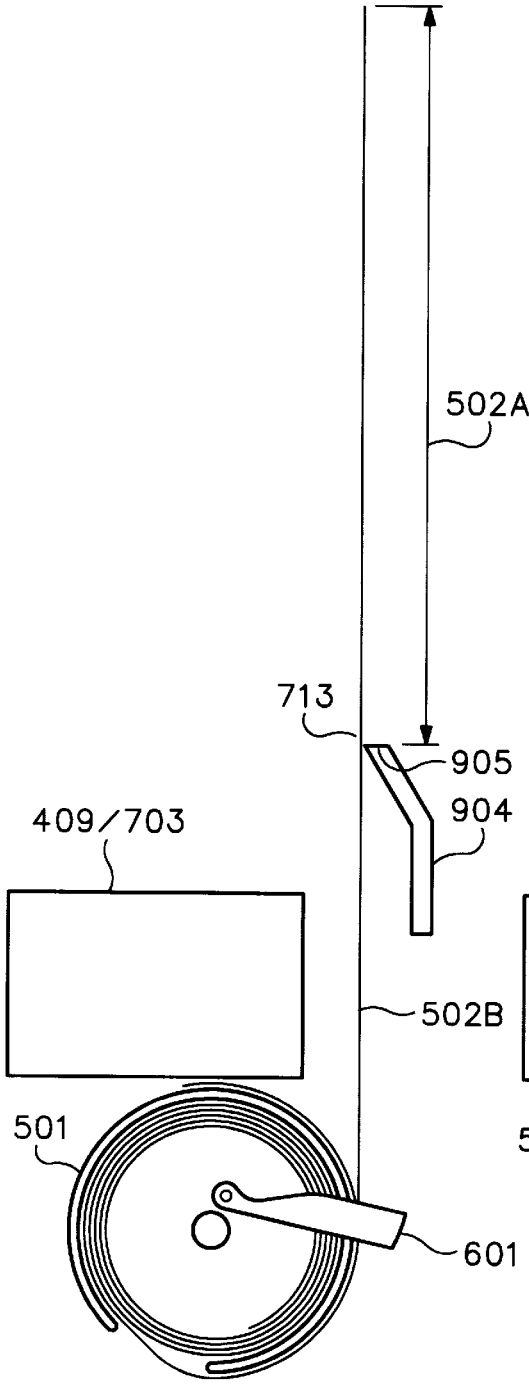
Figure 9E:
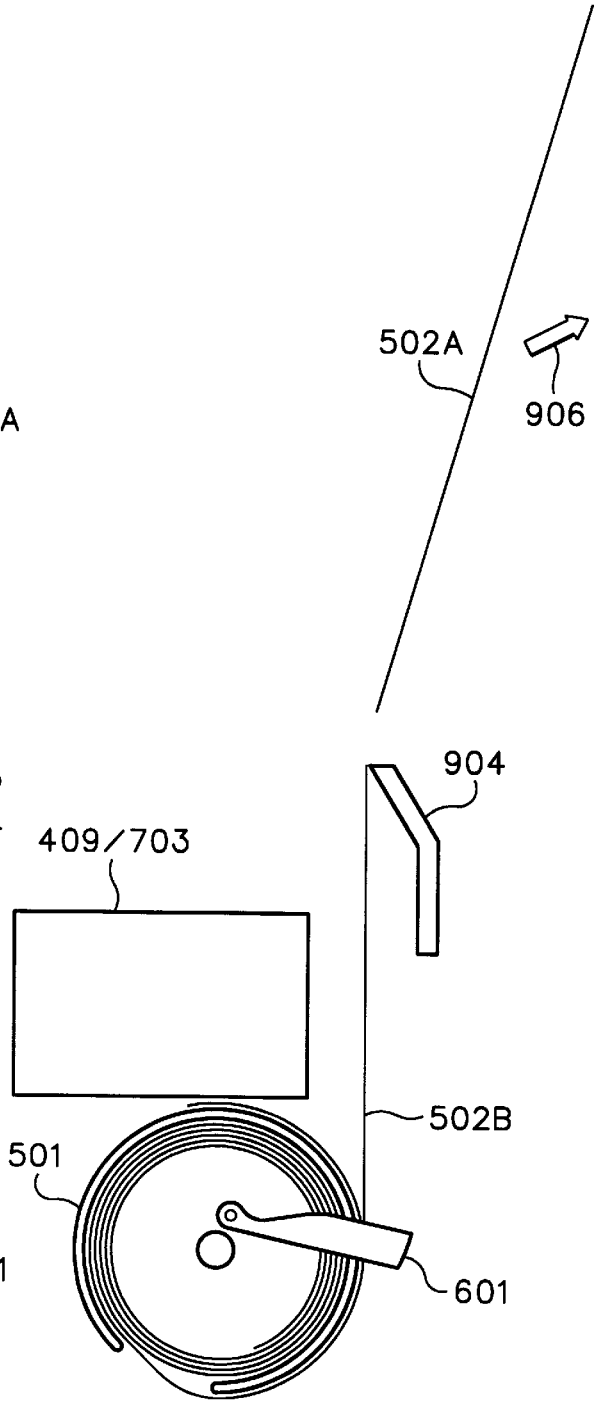

Turning to FIG. 9C, the finished print 502A is pulled until the drum 501 and clamp 601 are positioned to lock the drum—again in any known manner—from further rotation in the direction of arrow 902. Note that as the paper supply 502 is connected to the trailing edge of the print 502A as discussed above, the further pulling of the print extracts a next length 502A of paper from the interior of the drum 501 via the aperture 507 as demonstrated by FIG. 9C. The finished print 502A is pulled past the tear bar 904 until the trailing edge 713 of the print is positioned with a knife edge 905 of the tear bar as shown in FIG. 9D. As illustrated by FIG. 9E, the finished print 502A is torn off and removed as indicated by the arrow 906.

Figure 9F:
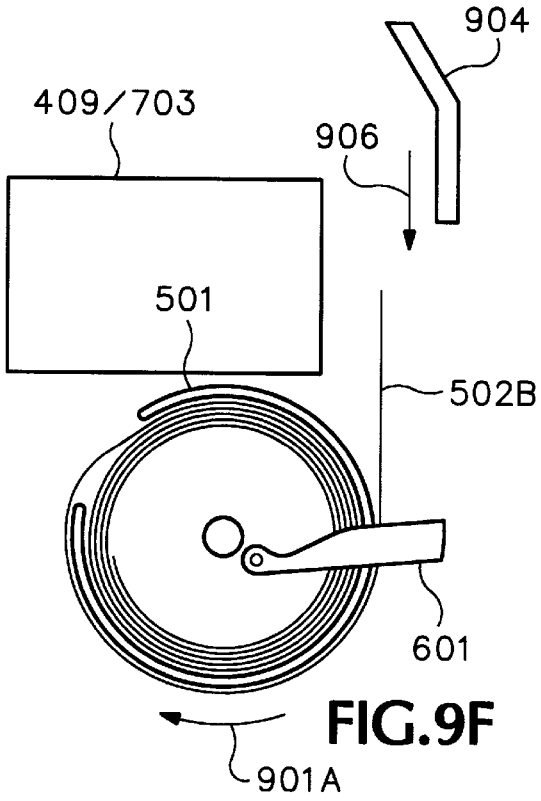
Figure 9G:
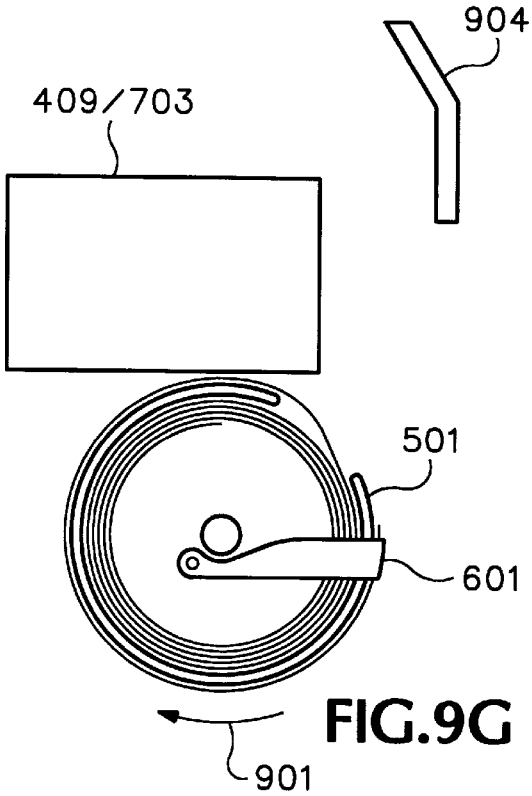

Referring to FIG. 9F, the drum 501 rotates back (arrow 901A) toward a position for rendering the next print. The next paper length 502B is retrieved (arrow 906) and wound onto the drum's outer surface. Rotation continues until the clamp 601 closes on the leading edge of what has now automatically become the current length of paper for printing as demonstrated in FIG. 9G. The next printing operation can now be started.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. It can be recognized that the cartridge 501 can be adapted to many design implementation and can be either a disposable and replaceable or refillable. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . "

What is claimed is:

1. A method of moving spooled media relative to an outer surface of a drum in a recording apparatus, comprising the steps of:

storing the media inside the drum;

extending a first length of the spooled media from inside the drum through an opening in the drum;

wrapping the first length of the media around the outer surface of the drum thereby to expose the wrapped media for recording thereon and;

rotating the drum to unwrap the first length of the media from the drum thereby to enable separation of the first length of media from the spooled media.

2. The method of claim 1 including the steps of:

rotating the drum in a first direction for wrapping the media; and rotating the drum in a second direction that is opposite the first direction for unwrapping the media.

3. The method of claim 1 including, after the step of rotating the drum to unwrap the first length of the media, the steps of:

extending a second length of spooled media from inside the drum through the opening in the drum;

separating the first length of media from the second length; and wrapping the second length of the media around the outer surface of the drum thereby to expose the wrapped second length of media for recording thereon.

4. The method of claim 2 wherein the step of wrapping the second length of media comprises rotating the drum.

5. The method of claim 2 wherein the steps of extending the second length of spooled media from inside the drum through the opening in the drum and wrapping the second length of the media around the outer surface of the drum to expose the wrapped second length of media for recording thereon are carried out in the absence of returning any extended media back inside of the drum.

6. The method of claim 2 wherein the step of separating the first length of media from the second length of media occurs after the step of extending the second length of spooled media from inside the drum through the opening in the drum.

7. The method of claim 1 including the step of providing the spooled media on a replaceable spool.

8. The method of claim 1 including the step of providing the spooled media inside of a disposable drum.

9. A method of securing a length of spooled media to the outer surface of a drum of a recording apparatus, comprising the steps of:

providing an opening in the drum;

storing the media inside of the drum with one end of the media extending through the opening, the end of the media having an outermost leading edge; and clamping the leading edge of the extended end of the media between a clamp member and the outer surface of the drum so that between the clamp and the slot the length of media is wrapped around the outer surface of the drum.

10. The method of claim 9 wherein the clamping step locates the clamped end of the media at a location spaced from the opening, thereby providing on the outer surface of the drum a gap over which the length of media is not wrapped.

11. The method of claim 10 including the step of providing in the gap a receptacle for receiving recording matter such as waste ink.

12. A media cartridge assembly for a recording device, comprising:

an elongated cylindrical drum having a slot formed along its length and having a cylindrical outer surface;

means for carrying recording media inside the drum with a portion of the media extending from inside the drum; and a clamp carried on the drum and movable into a clamping position for clamping the portion of the media to the outer surface of the drum.

13. The assembly of claim 12 wherein the clamp is located away from the slot and has a part that bears against the outer surface of the drum so that a sheet of media can be clamped between that part and the outer surface.

14. The assembly of claim 12 wherein the media portion that protrudes from the slot includes an outermost edge that is clamped by the clamp.

15. The assembly of claim 12 wherein the assembly is arranged so that the portion of media is secured against the outer surface of the drum between the slot and the clamp and forms a substantially continuous curve that matches the cylindrical curve of the drum outer surface.

16. The assembly of claim 12 including a servicing receptacle carried on the outer surface of the drum between the slot and the clamp and spaced from the portion of the media.

17. The assembly of claim 12 wherein the clamp is carried on the drum and movable into and out of the clamping position in response to rotation of the drum in opposite directions, respectively.

18. The assembly of claim 12 further comprising encoded information on both the drum and the media thereby to permit calculation of the position of the media relative to the drum.

19. The assembly of claim 12 including means for rotating the outer surface of the drum for wrapping and unwrapping the media around the outer surface.

* * * * *